US005762127A

United States Patent [19]

Benedetti et al.

[11] Patent Number: 5,762,127

[45] Date of Patent: Jun. 9, 1998

[54] METHOD TO CONTROL THE DEFORMATIONS OF THE SIDEWALLS OF A CRYSTALLISER AND CONTINUOUS-CASTING CRYSTALLISER

[75] Inventors: Giampietro Benedetti, Campoformido; Milorad Pavlicevic, Udine; Gianni Gensini, S.Stefano Di Buia; Alfredo Poloni, Redipuglia, all of Italy

[73] Assignee: Danieli & C. Officine Meccaniche SpA, Buttrio, Italy

[21] Appl. No.: 470,453

[22] Filed: Jun. 6, 1995

[30] Foreign Application Priority Data

| | | | |
|---|---|---|---|
| Jun. 6, 1994 | [IT] | Italy | UD94A0096 |
| Feb. 6, 1995 | [IT] | Italy | UD95A0013 |
| Feb. 6, 1995 | [IT] | Italy | UD95A0015 |

[51] Int. Cl.[6] ..... B22D 11/04

[52] U.S. Cl. ..... 164/485; 164/443

[58] Field of Search ..... 164/418, 459, 164/443, 485

[56] References Cited

U.S. PATENT DOCUMENTS

| | | | |
|---|---|---|---|
| 3,520,352 | 7/1970 | Hess | 164/485 |
| 3,667,534 | 6/1972 | Kanobogi et al. | 164/418 X |
| 3,886,991 | 6/1975 | Meier et al. | 164/485 X |
| 3,933,192 | 1/1976 | Rodenchuk et al. | 164/459 X |
| 4,690,200 | 9/1987 | Okamoto | 164/443 X |
| 5,095,970 | 3/1992 | Klein et al. | 164/443 X |

FOREIGN PATENT DOCUMENTS

| | | | |
|---|---|---|---|
| 2223115 | 10/1974 | France . | |
| 2661120 | 10/1991 | France . | |
| 1916503 | 1/1970 | Germany . | |
| 2106634 | 8/1972 | Germany . | |
| 3423475 | 11/1984 | Germany . | |
| 4127333 | 2/1993 | Germany . | |
| 53-77840 | 7/1978 | Japan | 164/459 |
| 53-45779 | 12/1978 | Japan | 164/443 |
| 273044 | 8/1986 | U.S.S.R. | 164/443 |
| 1400769 | 6/1988 | U.S.S.R. | 164/418 |

OTHER PUBLICATIONS

Metallurgical Transactions B., vol. 13B Mar. 1982, pp. 91–104 Samarasekera et al "Thermal Distortion of Continuous–Casting Billet Molds".

Patent Abstracts of Japan, vol. 8, No. 136 Jun. 23, 1984 & JP A 59–035856 (Kawasaki Seitetsu KK) Feb. 27, 1984.

*Primary Examiner*—J. Reed Batten, Jr.

*Attorney, Agent, or Firm*—Antonelli, Terry, Stout, & Kraus, LLP

[57] ABSTRACT

Crystalliser and method to control the deformations of the sidewalls of a crystalliser (11) for the continuous casting of billets/blooms/slabs (24), which is associated with a mould (10) and cooperates externally with a box-shaped structure (13) creating a cooling chamber (14), in which a cooling fluid circulates, and cooperates internally with the skin of the billets/blooms/slabs (24) being formed, the cooling chamber (14) containing an intermediate wall (20) creating a circulation channel (21) in cooperation with the outer surface of the sidewall (12) of the crystalliser (11), at least one upper zone (37) being included in cooperation at least with the vicinity of the meniscus and with the portion below the meniscus (27) of liquid metal, a lower zone (38) being also included and beginning in the vicinity of the zone of separation of the forming skin from the inner surface of the sidewall (12) of the crystalliser (11) and extending towards the outlet of the crystalliser (11), the pressure of the cooling fluid in the lower zone (38) of the crystalliser (11) being a function of the desired value (g1) of an air interspace (36) between the sidewall (12) of the crystalliser (11) and the skin of the forming billet/bloom/slab (24), this desired value of air interspace (36) tending towards a zero value.

41 Claims, 3 Drawing Sheets

METHOD TO CONTROL THE DEFORMATIONS OF THE SIDEWALLS OF A CRYSTALLISER AND CONTINUOUS-CASTING CRYSTALLISER

BACKGROUND OF THE INVENTION

This invention concerns a method to control the deformations of the sidewalls of a crystalliser, and a continuous-casting crystalliser.

The invention is employed in association with a mould used in a continuous casting plant for the production of billets, blooms or slabs of any desired type and section.

The field of continuous casting still entails a plurality of problems which have not yet been overcome and which are linked to the high temperatures to which the sidewalls of the crystalliser are subjected.

To be more exact, it is known that the temperature of the sidewalls of the crystalliser, notwithstanding the circulation of cooling fluid, changes in the direction of the casting with a maximum value reached at about the meniscus of the molten metal.

The uneven temperature along the sidewalls of the crystalliser causes an uneven deformation of those sidewalls together with their outward displacement in relation to their initial position in the cold state, this deformation being due to the thermal expansion of the material, with resulting problems linked to the surface faults caused by this uneven deformation on the billets or blooms being formed.

Owing to the deformation of the crystalliser caused by the thermal field the sidewalls of the crystalliser in their upper zone (see FIGS. 1*a* and 1*b* and the zone 37, which shows in an intentionally deformed manner the behaviour of the median line of a sidewall 112 of a crystalliser of the state of the art) take on a great negative taper 28, namely outwards, in their first segment 137 immediately below the meniscus 27 and then take on a positive taper in the successive segment 237.

FIG. 1*b* indicates with the reference line "O" the position in the cold state of the sidewall 212 of the crystalliser, which in this case is shown as being straight but which could also take on one of the different known forms with which the sidewalls of the crystalliser are embodied.

The strongly negative taper, shown with the line "28" in the upper zone 37 causes the solidifying billet/bloom/slab 24 to penetrate deeply within the deformed sidewall 112 of the crystalliser with resulting great difficulties of extraction and descent of the cast product.

Moreover, this negative taper entails great problems during the vertical oscillations which the mould undergoes to assist descent of the cast product.

Furthermore, an air space of a value "g1" is caused in the lower zone 38 of the crystalliser between the sidewall 112 of the crystalliser and the skin of the product owing both to the shrinkage of the solidifying skin and to the outward deformation of the sidewall 112 due to the thermal field.

The progressive separation of the skin from the sidewall 112 of the crystalliser takes on great values and involves problems of the uniformity of the cooling, with a resulting very great reduction of heat exchange and therefore of formation of the skin.

Moreover, even without taking account of the above drawbacks due to the great negative taper in the first upper segment 137 of the upper zone 37, the heat exchange in the rigid crystallisers of the state of the art has acceptable values only along the first segment 137 of the crystalliser extending along about one quarter of the length of the same, normally about 200 mm. below the meniscus, where the skin of the billet/bloom/slab is substantially in contact with the sidewall of the crystalliser.

In the lower zone 38 of the crystalliser, where the separation of the skin from the sidewall of the crystalliser takes place, the heat exchange is greatly reduced to a value of heat flux of about 1.5 to 2 $MW/m^2$.

The article of J. K. BRIMACOMBE "Empowerment with Knowledge—Towards the Intelligent Mould for the Continuous Casting of Steel Billets", METALLURGICAL TRANSACTIONS B, Volume 24B, DECEMBER 1993, pages 917–930, shows clearly that in crystallisers of the state of the art the heat flux in the zone of the exit of the cast product from the crystalliser is between about 1.2 and 1.4 $MW/m^2$, whereas it does not exceed 2 $MW/m^2$ in the zone where the separation of the skin from the sidewall of the crystalliser begins.

So as to ensure that the billet/bloom/slab leaving the crystalliser has a thickness of skin such as to prevent its breakage and the resulting break-out of liquid metal, it is therefore necessary to employ a reduced casting speed.

So as to prevent separation of the skin of the billet/bloom/slab from the sidewalls of the crystalliser, crystalliser models having a variable section have been disclosed in which the sidewalls converge in the downward direction; to be more exact, the shape of the development of the sidewalls of the crystalliser along the casting direction has been proposed to be a function of the coefficient of shrinkage of the material.

Attempts have been made with the various tapers of the crystalliser to minimise the air space which is created between the solidified skin and the sidewalls of the crystalliser so as to prevent the great reduction of heat flux.

This system, however, is not financially advisable inasmuch as the crystalliser has to be replaced on each occasion when the composition of the metal being cast is altered, and therefore this system causes great problems upon variation of the extraction speed, thereby involving a burden for the user.

So as to attempt to reduce the deformation of the sidewalls of the crystalliser, rigid crystallisers have been employed the sidewalls of which have a thickness at the meniscus of about 11 mm. or more, but this contrivance has not solved the problem.

Where the billets or blooms have a square, rectangular or generally polygonal cross-section, another problem is linked to the fact that the corners of the billet or bloom in the upper segment of the crystalliser are subject to a more intense cooling since at those corners the heat is removed on both sides of the corner.

The result is that at the corners of the billet or bloom the skin forms more quickly and the resulting shrinkage of the material has the effect that the billet or bloom is separated very soon from the sidewalls of the crystalliser, thus interrupting the cooling and solidifying process and tending to bring the solidified part, back to a liquid state.

For this reason the skin of the billet or bloom at the corners is less thick than along the sidewalls of the billet or bloom, and gradients of temperature between the corners and the sides of the billet or bloom are created.

These temperature gradients generate tensions both within the sidewalls of the crystalliser and within the billet or bloom being cooled, and these tensions lead to the formation of cracks and other surface faults which reduce the quality of the outgoing product.

Moreover, so as to avoid excessive abrasion of the sidewalls of the crystalliser, the inner surface of those sidewalls is generally lined with Ni/Cr, which however possesses little slipperiness.

In the crystallisers of the state of the art it is therefore necessary to employ lubricating oils or powders which entail an additional production cost and which reduce the heat exchange still further.

SUMMARY OF THE INVENTION

The present applicants have designed, tested and embodied this invention to overcome the shortcomings of the state of the art and to achieve further advantages, such as in particular an appreciable increase in the speed of extraction.

The purpose of this invention is to provide a method to control the deformations of the single sidewalls of a crystalliser for the continuous casting of billets/blooms/slabs, so that this deformation is almost nil, together with cancellation of the negative taper of the first segment of the crystalliser or even with the taper being directed towards the inside of the crystalliser with a view to improving the working of the crystalliser and to achieving greater extraction speeds.

A further purpose is to provide a crystalliser in which, on the one hand, the separation of the skin of the solidifying billet/bloom/slab from the sidewall of the crystalliser is reduced and, on the other hand, the thermal deformation of the single sidewalls of the crystalliser is compensated so that the sidewalls follow the natural shrinkage of the solidifying billet/bloom/slab.

The crystalliser according to the invention has sidewalls with an average thickness of a reduced value, between 4 and 15 mm. but advantageously between 4 and 10 mm., in proportion to their width, so that they have a substantially resilient behaviour according to the pressure of the cooling fluid acting on the outside of the sidewalls.

This pressure has a value strictly correlated with that thickness so as to ensure the resilient behaviour.

To be more exact, the single sidewalls of the crystalliser according to the invention adapt themselves to the respective sides of the billet/bloom/slab being formed while that billet/bloom/slab solidifies during its passage through the crystalliser.

According to the invention this adaptation of the sidewalls of the crystalliser is caused by the pressure of the cooling fluid, so that, by acting longitudinally on the pressure or on the reduction of pressure within a channel for circulation of the cooling fluid, the deformation induced in the sidewall is varied, thus also making possible the adaptation of the crystalliser to a plurality of types of cast metal and to various fields of casting speeds.

In the first formulation of the method according to the invention the sidewalls of the crystalliser have specific longitudinal zones associated with a specific pressure of the cooling fluid, the pressure being variable between one longitudinal zone and another according to a desired range of pressures.

In this way, upon variation of the lateral dimension of the sidewall, the different pressures employed make possible also the use of different thicknesses of sidewall in the same crystalliser.

A second formulation of the invention arranges that at least one longitudinal sidewall of the crystalliser is associated with at least one specific range of pressures of the cooling fluid.

In this invention, by cooling fluid is generally meant water for industrial use, at any rate water which is normally used to cool the crystalliser, and such water will be employed hereinafter as a reference element.

According to a variant the invention arranges to employ as a cooling fluid water to which has been added substances which enable that water to be used even at temperatures lower than "0" and down to −25° C./−30° C. upon entry into the mould.

A variant of the invention arranges for the use, as a cooling fluid, of other liquid substances such as glycol, for instance, at a temperature between −10° C./−15° C. and −70° C./−80° C. upon entry into the mould.

A further variant of the invention covers the use, as a cooling fluid, of liquefied gases, whether pure or combined with other gases or liquids, at a temperature between −3° C. and −270° C. upon entry into the mould.

Hereinafter, for simplicity of description, by cooling fluid is meant water, also called normal water, as normally used to cool continuous casting moulds in an industrial process.

The crystalliser is embodied in such a way that its dimensions in its transverse direction already take partial account of thermal expansion due to its heating; in such a case the vertical median line in the cold state may be straight or may already have a positive taper substantially in the vicinity of the meniscus.

The crystalliser is advantageously dimensioned in such a way that its cross-section, when it is in the state of normal expansion owing to the inclusion of liquid metal within it, corresponds substantially to the section of the billet/bloom/slab which is to be produced at its outlet.

Moreover, the crystalliser is dimensioned in such a way that its longitudinal section takes into account a typical expansion for a given range of steels which are to be cast with that crystalliser.

The invention provides for the use of pressures much higher than those normally used; in any event the invention arranges that the pressure of the cooling fluid is correlated with the deformation desired at a given longitudinal zone of the sidewall of the crystalliser in relation to the thickness of that sidewall, to the characteristics of the material forming that sidewall (normally copper or copper alloy), to the characteristics of the cast material and to the extraction speed.

The pressure at which the cooling fluid is fed is therefore at least a function of the inward deformation to be imparted to the sidewall of the crystalliser, or at least to a zone of that sidewall in relation to the thickness of the relative sidewall at that zone.

The invention arranges that the pressure of the cooling fluid is such as will deform the sidewalls of the crystalliser inwards so as at least to recover the deformation induced by the thermal field along the crystalliser in order to keep the sidewall substantially straight along the nominal line in the cold state, or even displaced positively in relation to that nominal line.

By acting on the range of pressures it is possible to control the deformation of the single sidewalls in a different manner at the various heights of the crystalliser, thus obtaining different effects.

The scope of the invention includes also the correlation of the pressure of the cooling fluid with the value of the thermal flux to be removed from the molten metal through the sidewall of the crystalliser.

In relation to the vertical area positioned in the vicinity of, and immediately below, the meniscus of molten metal, the pressure of the cooling fluid acting against the sidewalls of the crystalliser recovers the deformation induced by the heat in those sidewalls of the crystalliser and makes them linear or substantially linear or even induces in them a positive displacement, namely towards the inside of the casting chamber.

In particular, the pressure of the cooling fluid eliminates the negative taper caused in the case of rigid crystallisers (FIGS. 1*a* and 1*b*), thus bringing about an improvement of the surface of the solidifying skin and a minimisation of the depth of the oscillation marks, namely those notches created in the skin owing to the oscillation of the mould during the descent of the cast product.

In relation to the whole vertical sidewalls of the crystalliser, the pressure of the cooling fluid can alter as desired the local or complete taper of the sidewalls.

In particular, with regard to the lower zone of the crystalliser where the separation of the forming skin from the sidewalls of the crystalliser begins with a resulting formation of an air space, the pressure of the cooling fluid has the result of minimising or even eliminating the air space created between the sidewalls of the crystalliser and the solidified skin of the billet/bloom/slab.

This enables a greater heat flux to be achieved than with the rigid crystallisers of the state of the art and enables a heat flux to be obtained in the lower zone up to 5 $MW/m^2$ between the sidewalls of the crystalliser and the skin being formed.

The pressure of the cooling fluid can be varied by maintaining a constant $\Delta P$ along the whole fluid circulation channel of a determined zone, so as to induce a substantially constant deformation or recovery of deformation along that whole zone.

According to a variant, the $\Delta P$ between the inlet and outlet can be made variable through one and the same fluid circulation channel so as to induce variable deformations or recovery of deformations suitable for the obtaining of a desired result along the height of the crystalliser.

According to a variant of the invention, the crystalliser is associated, in the longitudinal direction, with at least two cooling chambers with the relative fluid circulation channels so as to obtain at least two longitudinally consecutive and independently manageable zones, so that in those zones there may be differentiated and independent ranges of pressure of the cooling fluid.

According to the invention differentiated and independent cooling zones can also be obtained.

Moreover, according to the invention it is possible to obtain within each zone independent and different conditions of cooling and of ranges of pressure of the cooling fluid with regard to one or more surfaces of the crystalliser.

According to the invention the cooling conditions and pressure are governed by a data processor which receives the necessary information from measurement means, which cooperate with the sidewalls of the crystalliser and/or with the surface of the billet/bloom/slab emerging from the crystalliser.

The measurement means may be means to detect the temperature of the sidewalls of the crystalliser or else, or also, means to detect the surface temperature of the billet/bloom/slab in the vicinity of the position of the exit of the same from the crystalliser, or else, or also, means to detect the force of friction between the inner side of the sidewalls of the crystalliser and the skin of the forming billet/bloom/slab.

In the crystalliser according to the invention the temperature measurement means are associated at least with the lower part of the crystalliser where the separation of the skin from the sidewalls of the crystalliser takes place.

According to a variant the temperature measurement means are also associated with the surface of the billet/bloom/slab as the latter leaves the crystalliser.

In the upper zone of the crystalliser, where it is necessary to control the deformation of the sidewalls caused by the thermal field relative to the inclusion of the molten metal, the pressures according to the invention vary from 3 to 15 bar.

In the lower zone of the crystalliser, where the skin is separated from the sidewalls of the crystalliser, the pressure according to the invention vary from 5 to 20 bar.

Where the air space between the sidewalls and the skin takes on in a given zone a value higher than that envisaged, the invention arranges to increase in feedback the pressure of the cooling fluid so as to bring the value of the air space back to the desired value.

According to a variant, where the billet/bloom has a rectangular section, the wider sidewalls of the rectangle of the crystalliser are governed by independent pressures different from the pressures acting on the narrower sidewalls.

According to a variant, the sidewalls are subjected to the same range of pressures but with an effect variable in relation to the different width, and possibly different thickness, of the sidewall.

By extension the invention arranges that each side of the crystalliser is subjected to its own independent range of pressures of the cooling fluid.

According to the invention the cooling fluid can flow in the same direction as, or in the opposite direction to, the direction of feed of the billet/bloom within the casting chamber.

According to a variant of the invention the fluid circulation channels do not affect the corner zones of the crystalliser, the purpose being to prevent causing an excessive cooling of the corners of the billet/bloom/slab being formed.

This situation ensures a uniform growth of the solidified layer and eliminates the tendency of the outgoing billet/bloom to take on a rhomboidal section.

According to a further variant of the invention these corners zone are cooled in a different manner from the rest of the sidewalls of the crystalliser.

At the corners the crystalliser according to the invention includes stiffening elements suitable at least to control the deformations of the crystalliser caused by the thermal expansion as a result of the heating of the crystalliser.

These stiffening elements are embodied directly in the crystalliser itself or are auxiliary external elements which are secured to, or are caused to cooperate with, the corners of the crystalliser.

The crystalliser according to the invention advantageously has its inner surface lined with lining materials possessing good thermal conductivity, good wear resistance and great slipperiness (low coefficient of friction), such as the carbides and/or other alloys of hard metals.

In the crystalliser according to the invention the lining materials are advantageously applied by means of the plasma spray technique, which ensures excellent adhesion of the lining materials even to the copper sidewalls.

According to a further variant, so as to increase the heat exchange between the cooling fluid and the sidewalls of the crystalliser, at least part of one surface of the fluid circulation channel includes flow disturbing means, which break up the fluid streams of the outermost layer of the fluid and cause the cooling fluid to run in a turbulent manner with a resulting increase of the heat exchange.

The disturbing means can be embodied by means of rough areas, hollows, sequences of enlargements and narrowings, etc.

Moreover, so as to improve the heat exchange, the outer surface of the sidewalls of the crystalliser may include ribs or other shapes.

In one form of embodiment of the crystalliser according to the invention the intermediate walls defining the fluid circulation chambers can be moved in relation to the sidewalls of the crystalliser and cooperate with adjustment means for their approach towards, or distancing from, those sidewalls.

This adjustment can be perpendicular to the sidewalls or can make possible the obtaining of desired angles between the sidewalls of the crystalliser and the intermediate walls.

This situation makes possible the variation, also in a longitudinal direction, of the transverse width, or span, of the fluid circulation channel and therefore of the cross-section of the passage of the cooling fluid, thus enabling the range of pressures and the speed of the cooling fluid in the fluid circulation channel to be regulated.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1A:
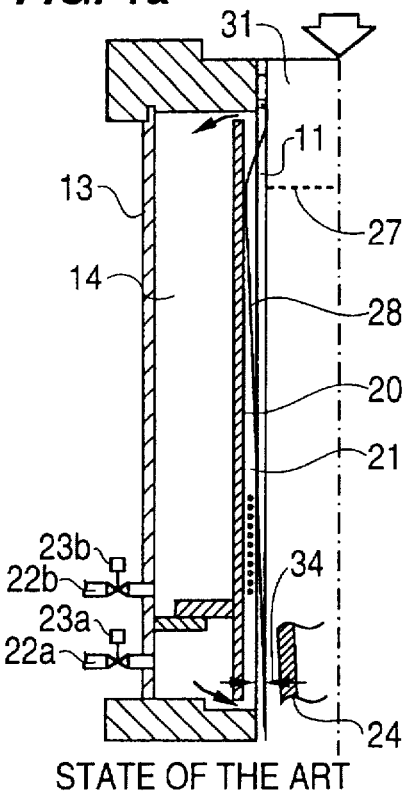
FIG. 1*a* shows a diagrammatic partial longitudinal section of a mould of the state of the art.

The reference number 10 in the attached figures denotes generally a mould according to the invention, with which a nozzle 25 to discharge molten metal is caused to cooperate.

The mould 10 can have a square, rectangular or polygonal cross-section or any desired cross-section.

The mould 10 according to the invention comprises a crystalliser 11 the sidewalls 12 of which have a thickness between 4 and 15 mm., but advantageously between 4 and 10 mm.

The sidewalls 12 of the crystalliser 11 have at least their inner surface lined with a material having a good thermal conductivity, a good resistance to wear and great slipperiness (a low coefficient of friction), such as the carbides for instance or other alloys of hard metals.

These lining materials are advantageously applied by the plasma spray technique or by hypersonic spraying.

The mould 10 according to the invention comprises containing walls 13 positioned outside the crystalliser 11 and defining therewith cooling chambers 14 in which a cooling fluid is caused to run.

Figure 3B:
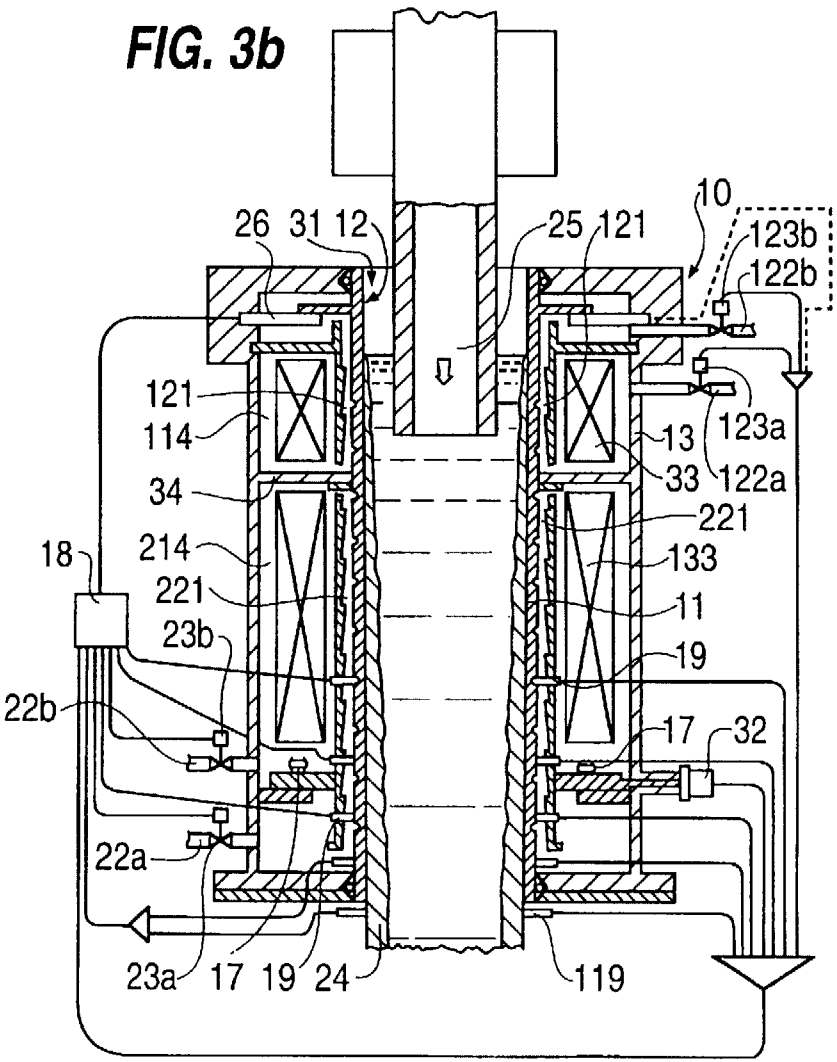
FIG. 3*b* shows a longitudinal section of a mould employing a crystalliser according to the invention and including two longitudinal cooling chambers.
Figure 3A:
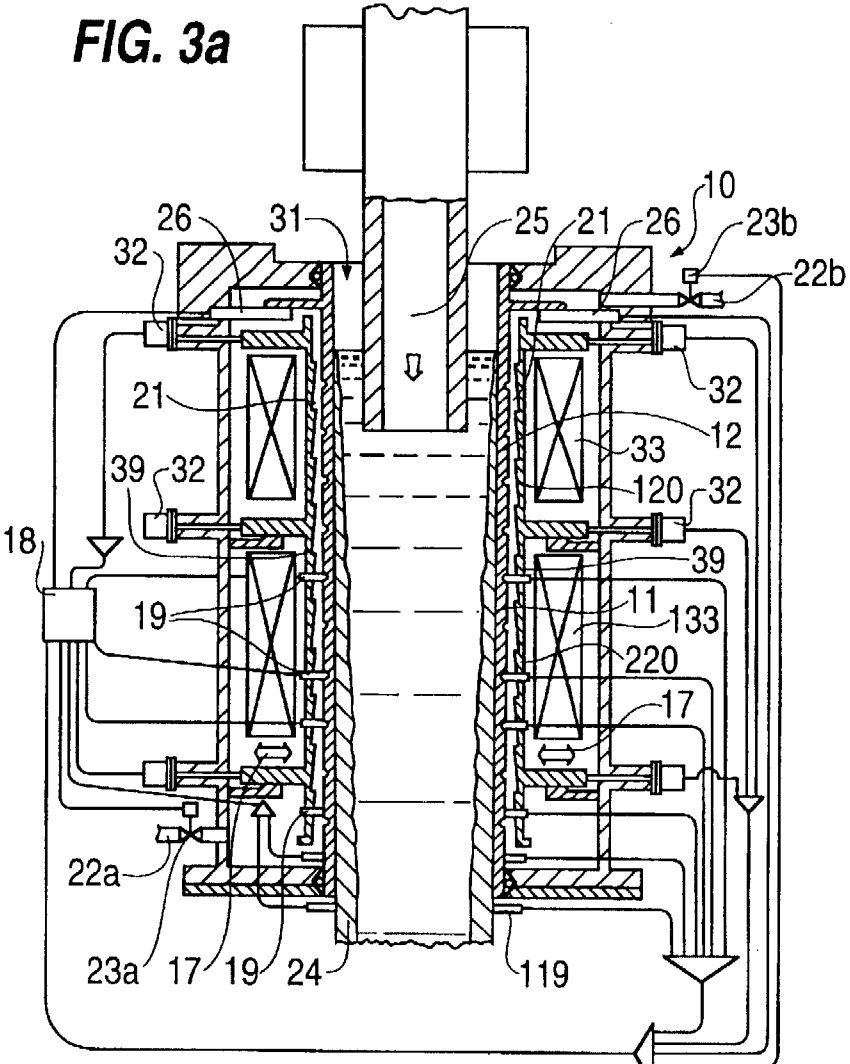
FIG. 3*a* shows a longitudinal section of a mould employing a crystalliser according to the invention and including one single longitudinal cooling chamber.
Figure 4B:
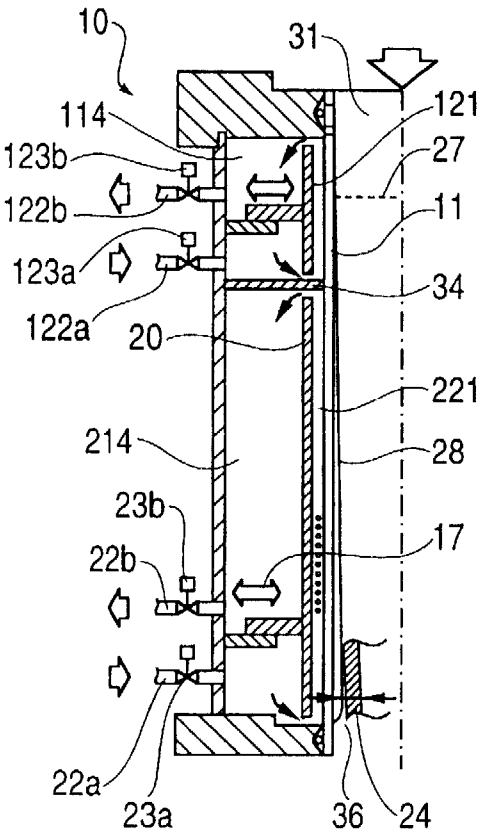
FIG. 4*b* shows a partial diagrammatic longitudinal section of a mould employing a crystalliser according to the invention and including two longitudinal cooling chambers.
Figure 4A:
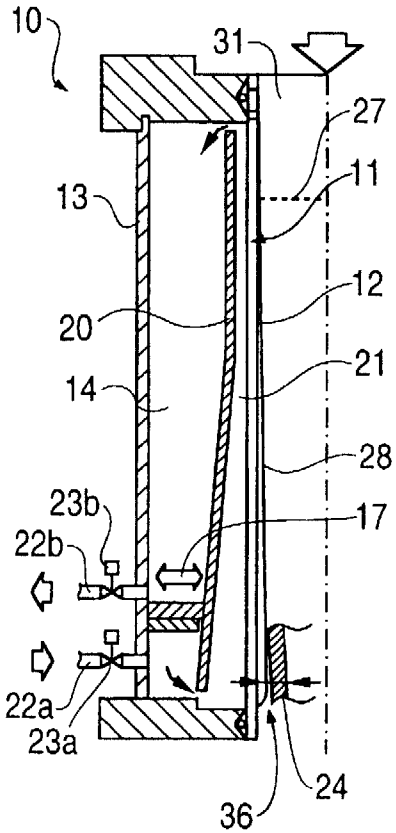
FIG. 4*a* shows a partial diagrammatic longitudinal section of a mould employing a crystalliser according to the invention and including one single longitudinal cooling chamber.

According to a first embodiment of the invention shown in FIGS. 3*a* and 4*a* the cooling chamber 14 is one single longitudinal chamber and takes up the whole longitudinal extent of the sidewall 12 of the crystalliser 11.

According to the variant shown in FIGS. 3*b* and 4*b* two or more cooling chambers 14 (114,214) are positioned longitudinally in sequence and in them the cooling fluid under pressure circulates independently.

According to the requirements of heat exchange between the cooling fluid and the crystalliser 11 and therefore in relation to the process of cooling and solidification of the billet/bloom/slab 24 being formed, the cooling fluid can circulate in the opposite direction to, or in the same direction as, the direction of feed of the billet/bloom/slab 24 being formed.

The cooling chambers 14 includes a feeder conduit 22*a*, 122*a* equipped with an adjustment valve 23*a*,123*a* and a discharge conduit 22*b*,122*b* also equipped with an adjustment valve 23*b*-123*b*.

These adjustment valves have the purpose of adjusting in a desired manner the feed pressure and/or the reduction of pressure of the cooling fluid within the specific cooling chambers 14,114,214.

The cooling chambers 14 in the mould 10 according to the invention contain on each side of the crystalliser 11 their own specific intermediate walls 20, which can be moved transversely according to the arrows 17 of FIGS. 3*a*–3*b* and 4*a*–4*b* by means of relative motors 32.

A fluid circulation channel 21 is provided between the intermediate wall 20 and the sidewall 12 of the crystalliser 11 and has a variable cross-section of its passage if the intermediate wall 20 is movable.

By adjusting transversely the position of the intermediate walls 20 it is possible to change the transverse width, or span, of the relative circulation channels 21 and therefore the hydraulic conditions of the flow of cooling fluid.

In the example of FIG. 3*a* the intermediate wall 20 is embodied with two parts, namely an upper part 120 and a lower part 220 with a line of connection 39 but can also be embodied with a plurality of parts.

The connection between the upper 120 and lower 220 parts is obtained at 39 by means of a hinge, a plurality of hinges or in another manner, so that it is possible to change independently the transverse width of the circulation channel 21 by modifying its geometry.

According to the invention, where there are sections with unequal sides, as in the case of rectangular sections, the wider sidewalls have pressure factors different from the pressure factors of the narrower sidewalls.

According to a variant each sidewall has its own independent range of pressures.

According to another variant each sidewall is divided into longitudinal zones defined by a specific range of pressures of the cooling fluid.

FIGS. 1a–1b and 4a–4b show the behaviour of crystallisers of the state of the art (FIGS. 1a–1b) and crystallisers according to the invention (FIGS. 4a–4b).

The crystalliser 11 in the vicinity of the meniscus 27 and therebelow, namely in the upper zone 37, is heated by the liquid metal running within the casting chamber 31 and is deformed outwards in a resilient manner (sidewall 112), and the pressure of the cooling fluid acting in the specific circulation channels 21,121 of that zone 37 acts in such a manner as to compensate that deformation and reduces it, thus cancelling the negative taper induced in the sidewalls or even imparting to the sidewalls a partial positive taper towards the inside of the casting chamber 31 (sidewall 12).

In the same way, in the remaining longitudinal part of the crystalliser 11, or lower part 38, which may include one or more cooling chambers 14,214 and respective circulation channels 21–221 according to the behaviour of the skin being formed, the pressure of the cooling fluid in the relative specific circulation channel 21,221 enables the interspace 36 between the sidewall 12 of the crystalliser 11 and the skin of the solidifying billet/bloom/slab 24 to be reduced until it has been cancelled.

Figure 1B:
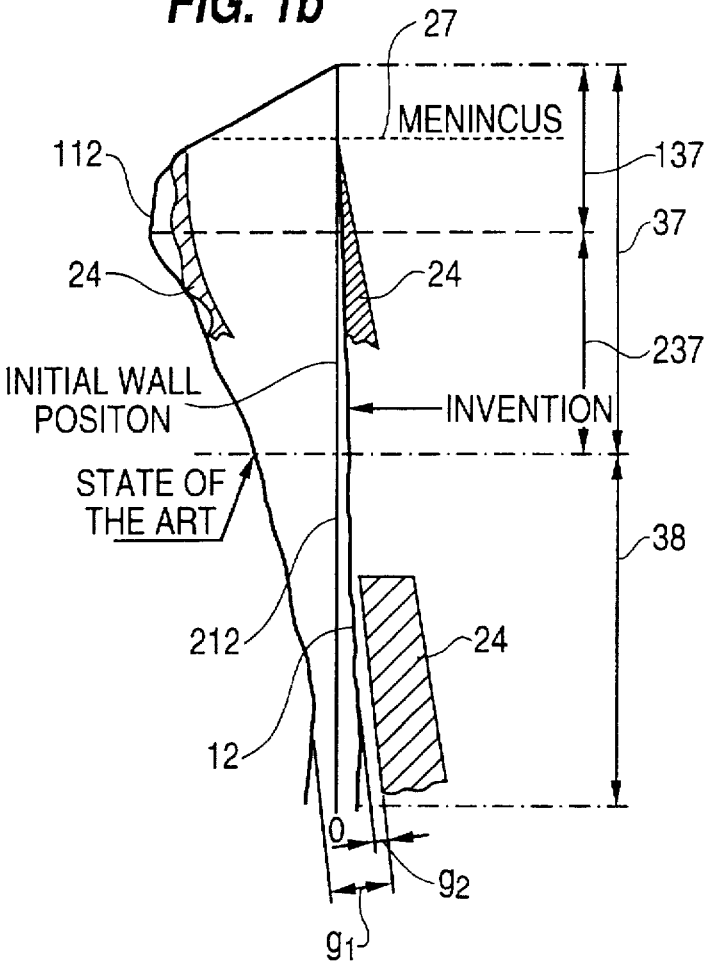
FIG. 1*b* shows with a partial diagrammatic section a comparison in an enlarged scale of the deformations of a crystalliser of the state of the art with the deformations of a crystalliser according to the invention.

The situation of maintaining an interspace 36 at a very reduced value "g2" or at a nil value enables the coefficient of heat exchange between the billet/bloom/slab 24 and the crystalliser 11 to be kept at a high value, as shown in FIGS. 1b, 4a and 4b.

FIGS. 1a and 1b show with the line 28 that at the meniscus 27 the sidewall 12 of the crystalliser 11 bulges outwards and thereafter takes up lower down a positive taper; in the meantime the skin being formed of the billet/bloom/slab 24 has shrunk and creates, together with the outward deformation induced by the thermal field, an air interspace 36 of a value "g1" which reduces severely the removed heat flux.

By means of the invention the pressure of the cooling fluid eliminates the negative taper of the sidewall 12 of the crystalliser 11 in the zone below the meniscus 27 and, by displacing the sidewall 12 inwards, recovers and substantially cancels the air interspace 36.

The result of this severe reduction of the air interspace 36 and therefore of the thermal resistance which that air interspace 36 introduces is the increase of the heat exchange flux between the sidewall 12 and the skin of the billet/bloom/slab 24, for this flux can be increased from a value of 1.5 to 2 $MW/m^2$ in the case of crystallisers of the state of the art up to a value of 5 $MW/m^2$ in crystallisers 11 according to the invention.

In the case of a crystalliser 11 according to the invention with a rectangular section, at least its wider sidewalls include circulation chambers 14 and circulation channels 21 which are independent and have independent pressures of the cooling fluid.

The cooling chamber 14 in the example shown in FIGS. 3b and 4b is divided by separator walls 34 into two cooling chambers 114,214, each with its own independent circulation of cooling fluid 22a,22b,23a,23b,122a,122b,123a,123b.

As we said before, according to the invention the independent circulation can be extended so as to affect also single longitudinal zones of sidewall 12 of the crystalliser 11.

According to one embodiment of the invention the circulation channels 21 do not cooperate directly with the corners 15 of the crystalliser 11, which are not cooled by the cooling fluid running within the circulation channels 21.

In the form of embodiment shown in FIGS. 2a–2f a segment 35 of an increased thickness is included at the corners 15 of the crystalliser 11 so as to reduce the heat exchange with the cooling fluid.

Figure 2A:
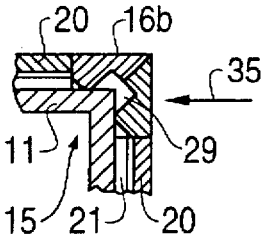
FIGS. 2*a* to 2*f* show partial cross-sections of some possible forms of embodiment of the stiffening element.
Figure 2B:
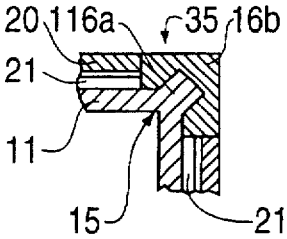
Figure 2C:
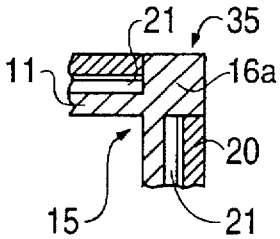
Figure 2D:
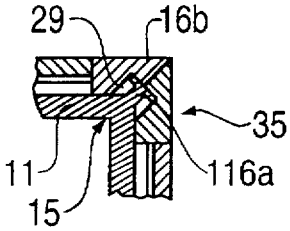
Figure 2E:
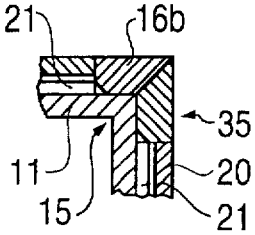
Figure 2F:
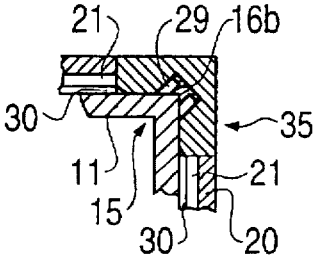

The segment 35 of an increased thickness can be embodied by means of stiffening elements 16 obtained wholly (16a—FIG. 2c) or partly (116a—FIGS. 2b and 2d) directly in the sidewall 12 of the crystalliser 11 or may consist of independent stiffening elements 16b (FIGS. 2a,2e,2f).

The independent stiffening elements 16b can be associated with or rigidly connected, by brazing for instance, to the corners 15 of the crystalliser 11 according to the invention.

A stiffening element 16a,116a provided in the sidewall 12 of the crystalliser 11 can be conformed as a solid polygon or have a T-shape or another form.

Where the stiffening elements 16b are independent, they can be conformed as a "T", or an "L" or an "Ω" or can have other forms.

In the form of embodiment shown in FIGS. 2d and 2f the stiffening element, which in FIG. 2d is provided partly 116a in the sidewall 12 of the crystalliser 11, whereas in FIG. 2f it is an independent element 16b, is T-shaped and is inserted in a space 29 defined in the segment 35 of an increased thickness.

Cooling fluid may or may not run through the space 29. The stiffening element 16, which may also consist of a plurality of pieces, performs the double task of stiffening and of reducing the heat exchange at the corners 15 of the crystalliser 11.

Figure 5:
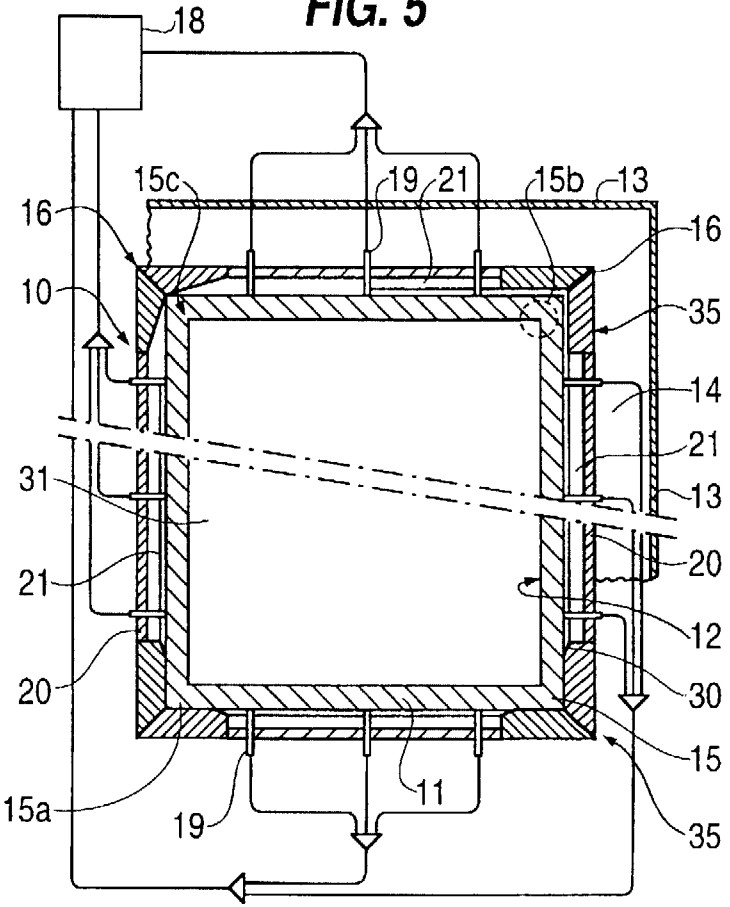
FIG. 5 shows a cross-section of a mould employing a crystalliser according to the invention.

In the embodiment shown as an example in FIG. 5 the segment 35 of an increased thickness has a stiffening element which is not in direct contact with the corners 15b of the crystalliser 11 but is separated therefrom by a given distance of about 0.3 to 0.6 mm.

Moreover, the embodiment relating to the corner 15b and the variant thereof relating to the corner 15c define a geometry suitable to increase the turbulence of the circulating cooling fluid and, amongst other things, to facilitate the alignment of the crystalliser 11.

The circulation channel 21 cooperates at its lateral ends with lateral inclined walls 30 having an inclination which can be varied as required so as to modulate and graduate the heat exchange near the corners 15 of the crystalliser 11 (FIGS. 2f–5).

The crystalliser 11 can be moved vertically and be rested on load cells 26, which record the force of friction of the billet/bloom/slab 24 against the sidewalls 12 of the crystalliser 11.

Moreover, the crystalliser 11 is associated, at various heights and advantageously along its whole length, with temperature measurement means 19,119, which measure respectively the temperature of the various zones on the sidewalls 12 of the crystalliser 11 and at the exit of the billet/bloom/slab 24 and on the billet/bloom/slab 24 leaving that exit.

The load cells 26 and the temperature measurement means 19-119 send their data to a data processor 18 which governs the adjustment valves 23a,23b,123a,123b and adjusts as required the pressure in the various cooling chambers 14,114,214 and in the respective circulation channels 21-121-221 and even in relation to each single vertical portion of the sidewalls 12.

The data processor 18 can also govern the motors 32 adjusting the transverse width, or span, of the circulation channels 21,121,221 and can regulate and, at any rate, control electromagnetic stirrers 33,133 so as to cause a circulation of their magnetic flow in the same direction or in opposite directions.

So as to increase the heat exchange between the cooling fluid and the crystalliser 11, the surfaces which define the circulation channels 21 can advantageously include disturbing elements, which break the fluid streams of the outermost layer of the fluid and cause the cooling fluid to run with a turbulent motion within the circulation channels 21 with a resulting increase of heat exchange.

These disturbing elements may be embodied on the outer surface of the sidewalls 12 of the crystalliser 11 and on the inner surface of the intermediate wall 20.

So as to increase the heat exchange, the outer surface of the sidewalls 12 of the crystalliser 11 may include grooves, rough areas, jutting portions or other means suitable to increase the surface of heat exchange, these grooves, rough areas, jutting portions or other means advantageously, but not only, extending vertically.

We claim:

1. Method to control the deformations of the sidewalls of a crystalliser of a mould for the continuous casting of billets/blooms/slabs, the mould comprising the crystalliser, a box-shaped structure provided externally to the crystalliser, creating a cooling chamber between the box-shaped structure and the crystalliser, and an intermediate wall provided in the cooling chamber creating a circulation channel through which a cooling fluid flows in cooperation with an outer surface of at least one resilient sidewall of the crystalliser, the crystalliser cooperating internally with a skin of the billet, bloom or slab being formed therein and having a plurality of longitudinal zones including at least one upper zone in cooperation at least in the vicinity of the meniscus of liquid metal in the crystalliser and with a portion below the meniscus of liquid metal, and a lower zone beginning in the vicinity of a zone of separation of the skin from the inner surface of the sidewall of the crystalliser and extending towards an outlet of the crystalliser, the method comprising controlling the pressure of the cooling fluid in the lower zone of the crystalliser to minimize an air interspace between the sidewall of the crystalliser and the skin of the forming billet, bloom, or slab.

2. Method as in claim 1, wherein, in at least one of the longitudinal zones of at least one sidewall of the crystalliser, the cooling fluid in the circulation channel is controlled to a pressure suitable to deform that zone of that sidewall of the crystalliser towards the interior of the crystalliser.

3. Method as in claim 1, further comprising controlling the pressure of the cooling fluid in the upper zone of the crystalliser to eliminate the negative taper of the sidewall induced by a thermal field in the upper zone.

4. Method as in claim 1, further comprising controlling the pressure of the cooling fluid in each longitudinal zone of at least one sidewall of the crystalliser to a range of pressure different than a range of pressure of another longitudinal zone.

5. Method as in claim 1, wherein the pressure of the cooling fluid acting on a specific longitudinal zone of the crystalliser is controlled to be equal on all the sidewalls of the crystalliser.

6. Method as in claim 1, wherein the pressure of the cooling fluid acting on a specific longitudinal zone of the crystalliser is controlled to a pressure specific for at least one sidewall of the crystalliser.

7. Method as in claim 1, wherein the pressure of the cooling fluid is controlled as a function at least of a thickness of the sidewall of the crystalliser.

8. Method as in claim 7, wherein the pressure of the cooling fluid is controlled as a function of the casting speed and the metal being cast.

9. Method as in claim 1, wherein a reduction of pressure within each circulation channel is a function of a required modification of an inward taper relating to a segment of sidewall associated with each circulation channel.

10. Method as in claim 9, further comprising modulating the reduction of pressure of the cooling fluid circulating within the circulation channels by altering at least one of a transverse width, span, and geometry of the circulation channels.

11. Method as in claim 10, wherein the reduction of pressure of the cooling fluid for a given geometry of the circulation channel is adjusted by acting on adjustment valves.

12. Method as in claim 1, wherein the cooling fluid is water.

13. Method as in claim 1, wherein the cooling fluid is water containing additives at a temperature down to −25° C./−30° C.

14. Method as in claim 1, wherein the cooling fluid is glycol at a temperature between −10° C. and −80° C.

15. Method as in claim 1, wherein the cooling fluid comprises liquid gas at a temperature between −3° C. and −270° C.

16. Method as in claim 12, wherein the pressure at an inlet of the circulation channel is controlled to between 5 and 20 bar.

17. Method as in claim 16, wherein the pressure of the cooling fluid in a portion of the cooling chamber associated with the lower zone of the crystalliser is between 5 and 20 bar.

18. Method as in claim 16, wherein the pressure of the cooling fluid in a portion of the cooling chamber associated with the upper zone of the crystalliser is between 3 and 15 bar.

19. Method as in claim 1, wherein the pressure of the cooling fluid in each longitudinal zone of the crystalliser is governed by a data processor.

20. Method as in claim 19, further comprising governing the data processor by temperature measurement means included at least in a zone corresponding to the lower zone of the crystalliser.

21. Method as in claim 1, further comprising controlling cooling of corners of the crystalliser to a less intense cooling than the sidewalls of the crystalliser.

22. A mould for the continuous casting of billets/blooms/slabs, comprising a crystalliser, a box-shaped structure provided externally to the crystalliser, creating a cooling chamber between the boxed-shaped structure and the crystalliser, an intermediate wall provided in the cooling chamber creating a circulation channel through which a cooling fluid flows in cooperation with an outer surface of at least one resilient sidewall of the crystalliser, the crystalliser cooperating internally with a skin of the billet, bloom or slab being formed therein and having a plurality of longitudinal zones including at least one upper zone in cooperation at least in the vicinity of the meniscus of liquid metal in the crystalliser and with a portion below the meniscus of liquid metal, and a lower zone beginning in the vicinity of a zone of separation of the skin from the inner surface of the sidewall of the crystalliser and extending towards an outlet of the crystalliser, and pressure control means for controlling the pressure of the cooling fluid in the lower zone of the crystalliser as a function of a desired value of an air interspace between the sidewall of the crystalliser and the skin of the forming billet/bloom/slab, the desired value of the air interspace tending towards a zero value, wherein at least one longitudinal zone of one sidewall of the crystalliser has a thickness between 4 and 15 mm, correlated functionally with the pressure of the cooling fluid within the relative circulation channel in relation to a required inward displacement of that sidewall.

23. Mould as in claim 22, wherein one and the same circulation channel laps all the sidewalls of the crystalliser.

24. Mould as in claim 21, in which at least one circulation channel is included for each sidewall of the crystalliser.

25. Mould as in claim 21, wherein a section of the circulation channel perpendicular to an axis of the crystalliser has a transverse length shorter than a transverse length of the relative sidewall of the crystalliser and a transverse width or span of the channel as much as 3 mm.

26. Mould as in claim 21, wherein corners of the crystalliser cooperate with a wall segment having an increased thickness.

27. Mould as in claim 21, further comprising stiffening elements associated with corners of the crystalliser.

28. Mould as in claim 27, wherein the stiffening elements are provided directly in the sidewalls of the crystalliser.

29. Mould as in claim 27, wherein the stiffening elements are auxiliary external elements which cooperate with the corners of the crystalliser.

30. Mould as in claim 21, further comprising load cells, connected to a data processor, for recording a force of friction of the billet/bloom/slab against the sidewalls of the crystalliser.

31. Mould as in claim 22, further comprising temperature measurements means associated with at least the lower zone of the crystalliser, the temperature measurements means being connected to a data processor.

32. Mould as in claim 31, wherein, at the exit of the crystalliser, temperature measurements means are provided to measure a temperature of the skin of an outgoing billet/bloom/slab.

33. Mould as in claim 22, further comprising means for adjustably moving at least part of the intermediate wall on at least one side of the crystalliser in relation to the sidewall of the crystalliser with which the intermediate wall is associated.

34. Mould as in claim 22, wherein at least one inside surface defining the circulation channel comprises disturbing elements to disturb an outermost layer of fluid streams of the cooling fluid.

35. Mould as in claim 22, wherein at least one of an outer surface of the sidewall of the crystalliser and an inner surface of the intermediate wall includes rough areas, grooves or jutting portions suitable to increase a heat exchange surface.

36. Mould as in claim 22, wherein the inner surface of the sidewall of the crystalliser is lined with carbides or other alloys of hard metals.

37. Mould as in claim 36, wherein the lining of the inner surface of the sidewall of the crystalliser is applied by deposition by means of plasma spray or by deposition by means of hypersonic spraying.

38. Mould as in claim 22, wherein the pressure control means comprise adjustment valves which regulate the pressure of cooling fluid circulating in the circulation channels, and a data processor for governing the adjustment valves.

39. Mould as in claim 22, further comprising at least one electromagnetic stirrer associated with the cooling chamber and governed by a data processor.

40. Mould as in claim 39, wherein the data processor governs a position of at least one longitudinal zone of the intermediate wall in relation to a relative portion of the sidewall of the crystalliser.

41. Mould as in claim 22, wherein at least an opposing pair of sidewalls of the crystalliser have a thickness between 4 and 10 mm.

* * * * *